US006389788B1

(12) United States Patent
Koltze

(10) Patent No.: US 6,389,788 B1
(45) Date of Patent: May 21, 2002

(54) METHOD AND DEVICE FOR AUTOMATICALLY DETECTING YARN CAKE REMNANTS DURING POT SPINNING

(75) Inventor: Karl Koltze, Mönchengladbach (DE)

(73) Assignee: W. Schlafhorst AG & Co. (DE)

( * ) Notice: Subject to any disclaimer, the term of this patent is extended or adjusted under 35 U.S.C. 154(b) by 0 days.

(21) Appl. No.: 09/636,323

(22) Filed: Aug. 10, 2000

(30) Foreign Application Priority Data

Aug. 13, 1999 (DE) ..... 199 38 433

(51) Int. Cl.[7] ..... D01H 1/08
(52) U.S. Cl. ..... 57/76; 57/264
(58) Field of Search ..... 57/76, 264

(56) References Cited

U.S. PATENT DOCUMENTS 5,699,658 A * 12/1997 Koltze et al. ..... 57/76
5,765,353 A 6/1998 Roland et al.
6,109,014 A * 8/2000 Koltze et al. ..... 57/76
6,244,029 B1 * 6/2001 Bruss et al. ..... 57/76

FOREIGN PATENT DOCUMENTS

| | | |
|---|---|---|
| DE | 38 22 930 A1 | 2/1989 |
| DE | 42 06 030 A1 | 9/1993 |
| DE | 42 06 031 A1 | 9/1993 |
| DE | 195 23 835 A1 | 1/1997 |
| DE | 195 48 667 A1 | 6/1997 |
| DE | 198 02 656 A1 | 7/1999 |

* cited by examiner

*Primary Examiner*—Andy Falik
(74) *Attorney, Agent, or Firm*—Kennedy Covington Lobdell & Hickman, LLP

(57) ABSTRACT

A method for operating a pot spinning machine which has a plurality of identical work stations each having a drafting device with a slubbing stop device, a spinning centrifuge rotating at high speed around an axis, and a tubular reciprocable guide. A slubbing emerging from the yarn guide mouth forms a rotating yarn leg which is deposited on the inner wall of the spinning centrifuge in the form of a spinning cake. At the start of a spinning cycle of the spinning machine, the individual spinning centrifuges of the spinning machine are checked for the presence of yarn cake remnants.

14 Claims, 2 Drawing Sheets

METHOD AND DEVICE FOR AUTOMATICALLY DETECTING YARN CAKE REMNANTS DURING POT SPINNING

CROSS REFERENCE TO RELATED APPLICATIONS

This application claims the benefit of German Application 19938433.9 filed Aug. 3, 1999, herein incorporated by reference.

FIELD OF THE INVENTION

The present invention relates to a method for centrifugal spinning of textile yarn within a rotatable spinning centrifuge, typically an open-ended cylinder, commonly referred to as pot spinning. More particularly, the present invention relates to a method of pot spinning on a spinning machine with a plurality of spinning stations whereat a fibrous rope or other suitable continuous supply of spinnable fiber, typically and preferably in the form of a sliver or a roving, is drawn by means of a drafting device, is guided via a tubular reciprocating yarn guide into a rotating spinning centrifuge, is spun into a yarn and, while forming a rotating yarn leg as the yarn exits the guide, is deposited in the form of an annular spinning cake on the inner wall of the spinning centrifuge. The present invention further relates to a pot spinning machine, having a plurality of work stations, each of which has a centrifuge rotatable about a shaft and a reciprocable yarn guide for introducing into the centrifuge a drawn fibrous sliver received from a drafting device.

BACKGROUND OF THE INVENTION

In pot spinning, a sliver is delivered from a sliver can and drawn in a drafting device, or a roving is delivered in the form of a speed frame bobbin, referred to collectively herein as a slubbing, is introduced into a rotating spinning centrifuge by means of a yarn guide reciprocable downwardly and upwardly within the centrifuge, is spun into a yarn, and is deposited as a so-called spinning cake on the inner wall of the spinning centrifuge.

More specifically, the slubbing delivered from the mouth of the yarn guide is transported by the action of an air flow rotating along with the spinning centrifuge to the inner wall of the spinning centrifuge and becomes fixed thereon centrifugally such that a moving yarn leg is created extending from the guide to the inner centrifuge wall and rotates around the centrifuge axis. The required twisting of the fibers of the sliver or roving necessary to form them into a yarn is imparted by means of the rotation of this yarn leg before it is deposited on the rotating inner surface of the centrifuge in the form of the spinning cake. At the end of a spinning cycle, e.g., after a predetermined amount of yarn has accumulated in the centrifuge, the yarn of the spinning cake which has been spun theretofore is rewound onto a rewinding tube introduced into the centrifuge. This rewinding process is initiated, for example, by pushing the rewinding tube forwardly into the centrifuge and into the path of the yarn leg. In the course of doing so, the rewinding tube grasps the rotating yarn leg coming out of the yarn guide by means of the leading edge of the tube, whereby the spinning cake deposited on the inner wall of the spinning centrifuge is then rewound onto the rewinding tube.

A yarn break can occur in the course of this rewinding process, resulting in a yarn body remnant remaining in the centrifuge after the rewinding of the yarn body onto the rewinding tube. A method and a device for restarting the rewinding process in pot spinning following such a yarn break are known from the later published patent application German Patent Publication DE 198 02 656. This document discloses the introduction of a special yarn loosening element into the centrifuge for grasping a yarn end of the yarn body remnant left in the centrifuge. Although yarn body remnants can be quite dependably removed from the spinning centrifuges by such a device, the occurrence and the presence of such yarn body remnants is often not noticed or noticed only very late.

Since such yarn body remnants also further reduce the already relatively limited receiving volume of the spinning centrifuges, it is important in the interest of the highest possible efficiency of a pot spinning machine to swiftly detect a yarn body remnant which has remained in the centrifuge, and to initiate appropriate counter-measures.

A method for pot spinning is known from German Patent Publication DE 195 23 835 A1, wherein the length of the rotation time of the yarn legs rotating in the spinning centrifuges is measured whereby a change of the length of the rotating time of the yarn leg occurring is immediately recognized and the already spun yarn body can be saved by introducing a rewinding tube.

It is furthermore known to detect the presence of a roving yarn introduced into the spinning centrifuge by means of a yarn sensor arranged between the drafting device and the reciprocable yarn guide tube. In the presence of the roving yarn, the yarn sensor provides an appropriate output signal. Here, the yarn sensor detects the movement of the roving yarn and provides an output signal which is proportional to the movement, preferably a noise signal. Such monitoring of the movement of the roving yarn is described, for example, in German Patent Publications DE 42 06 030 A1 or DE 42 06 031.

In case of a yarn break at a spinning station, an interruption of the material feed takes place as a rule. Thus, delivery of roving yarn is interrupted by means of a stop device acting on the slubbing. Such slubbing stop devices arranged in the area of the drafting devices are known from German Patent Publication DE 38 22 930 A1, for example.

OBJECT AND SUMMARY OF THE INVENTION

Based on the above mentioned prior art, it is an object of the present invention to provide a method and a device which assures in a simple and cost-effective manner that the individual spinning centrifuges of a pot spinning machine are in an optimal state at the start of the spinning cycle, in particular that the spinning centrifuges are empty without any spinning cake remnants.

This object is achieved in accordance with the present invention by a method wherein all spinning centrifuges of the pot spinning machine are checked for the presence of possible yarn body remnants at the start of a spinning cycle, which makes it possible to dependably avoid that spinning centrifuges which having a yarn remnant remaining in the spinning centrifuge, and hence would produce poor spinning cops, are placed into the normal spinning process.

More specifically, the present method contemplates that the rotary frequency of the yarn legs of the individual work stations of the pot spinning machine is determined at the start of a spinning cycle of the pot spinning machine, and the rotary frequencies for each work station is compared with a predetermined set value. Thus, possible yarn body remnants in one or several of the spinning centrifuges of the work stations can be immediately detected because of the appearance of differences in the rotary frequency in comparison with the set value. In the course of measuring the rotary frequency of the yarn leg, the fact is taken into account that piecing takes place on the possibly still present yarn body remnant and that the reduction in the free radius as a result of this also leads to a reduction of the rotary frequency of the yarn leg.

More specifically, in a centrifuge rotating at a constant rotary frequency, a yarn body remnant left in the spinning centrifuge immediately leads to a lower rotary frequency of the respective yarn leg, based on the equation:

$$f_G = f_Z - V_L / 2_\pi * r$$

wherein $f_G$ represents the rotary frequency of the yarn leg, $f_Z$ represents the rotary frequency of the centrifuge, $V_L$ represents the delivery speed of the yarn, and r represents the free radius of the centrifuge. It is therefore possible by means of an appropriate evaluation of the rotary frequency of the yarn legs to draw a direct conclusion regarding the presence of a yarn body remnant in the respective spinning centrifuge, which reduces the free radius.

In an advantageous embodiment of the invention, the rotary frequency of the rotating yarn leg is measured by means of a yarn sensor detecting the movement of the yarn. That is, a yarn sensor is arranged between the drafting device and the reciprocable tubular yarn guide to detect a yarn movement occurring in the area of the yarn sensor which corresponds to the rotary frequency of the yarn leg in the spinning centrifuge.

According to a further aspect of the invention, this yarn movement corresponding to the rotary frequency of the yarn leg is filtered out of the noise signal, which is detected by means of the yarn sensor and represents the movement of the yarn. For this purpose, the noise signal is conducted over a filter stage, for example, which detects a frequency signal based on the rotary frequency of the yarn leg. Processing of this frequency signal, for example by means of a fast Fourier transformation or the like, leads to frequency lines located in a defined spectral range, which can be unequivocally assigned to clearly defined free radii within the centrifuge.

By means of comparing these spectral lines with set values which are to be expected with empty centrifuges, the presence of a yarn body remnant can be immediately determined, so that appropriate counter-measures can be initiated. Since the free radius of an empty centrifuge is known because of the known geometric dimensions, the determination of a set value to be expected is possible in a simple manner.

In an advantageous feature of the invention, it is further provided that the rotary frequency of the yarn leg at each work station is determined simultaneously at all work stations. An unequivocal association of this data with each respective individual spinning station takes place in a measuring and evaluation unit, whereby it is possible by means of a comparison of the respective rotary frequencies from the work stations with the preset value to immediately determine whether and in which of the spinning centrifuges a yarn body remnant could possibly still be present. Since it is assumed that a yarn body remnant occurs seldom, and even more seldom at the same time at several work stations, the detected numbers of revolution of the yarn legs can also be compared with each other, so that it is possible to omit the provision of an external set value. In effect, the spinning stations not showing a yarn body remnant provide an internal set value.

Upon detecting a yarn body remnant in a spinning centrifuge, an appropriate control signal is immediately issued to the slubbing stop device of the respective work station via the evaluation unit, whereby the further delivery of roving yarn is stopped at the respective work station.

The objective of the invention is furthermore attained by providing the pot spinning machine with a sensor arrangement which makes it possible to detect at least one of the physical values appearing during a spinning cycle. The detected value is compared with a predetermined set value, for example in a work station computer or in a central spinning machine computer, and conclusions regarding the load status of the individual spinning centrifuges are drawn from the result of this comparison.

In this invention, the sensor arrangement is preferably designed as a yarn sensor, located between the drafting device and the yarn guide, which detects the presence of the slubbing. Because a filter stage is assigned to this yarn sensor, a signal corresponding to the rotary frequency of the yarn leg can be filtered out of the output signal of the yarn sensor and the signal may therefore be used for comparison with a set value signal in an evaluation circuit.

In this manner, a detection and evaluation of the rotary frequency of the yarn legs rotating with the spinning centrifuges can take place without extensive structure or structural modifications to the spinning machine, which might possibly require additional structural space. More specifically, only a filter stage, and a comparator which compares the signals, are required for modifying an already existing device such that, through the measurement of the rotary frequency of the yarn legs, conclusions can be immediately drawn regarding the possible presence of a yarn body remnant in one of the spinning centrifuges.

According to a further aspect of the invention, the pot spinning machine has a central control device, in which the signals provided by the individual yarn sensors are evaluated in regard to the detected rotary frequency of the yarn legs. In this manner, it is possible advantageously to perform a comparison with the set value in a compact unit, wherein the set value need only be made available once for all spinning stations. It is furthermore possible in an alternative embodiment to perform a comparison of the rotary frequency of the yarn legs of the individual work stations in respect to each other in a simple way by means of the control device.

Further aspects, features and advantages of the present invention will be explained in greater detail and will be understood form the following disclosure of an exemplary embodiment represented in the accompanying drawings.

DETAILED DESCRIPTION OF THE PREFERRED EMBODIMENT

Figure 1:
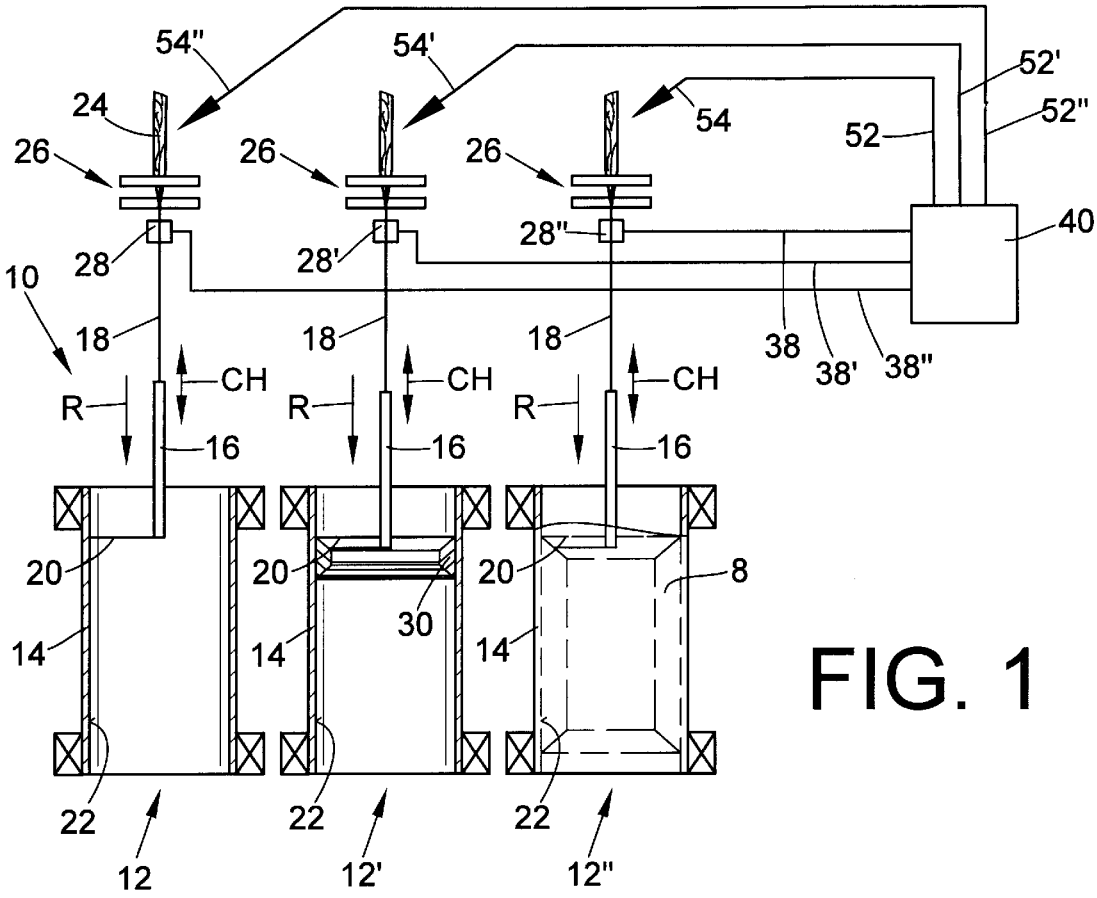
FIG. 1 is a schematic front elevational view of three work stations of a pot spinning machine, in accordance with the method and device of the present invention.

Referring now to the accompanying drawings and initially to FIG. 1, a pot spinning machine is schematically represented at 10 and basically comprises a plurality of work stations 12. Three of these work stations, 12, 12', 12", are partially represented in FIG. 1.

Here, each work station 12, 12', 12" respectively includes a spinning centrifuge 14 supported, for example, on magnetic bearings (not represented), for rotation of the spinning centrifuge 14 at high speeds.

A reciprocable tubular yarn guide 16 is associated with each spinning centrifuge 14 and is disposed with a longitudinal axis of the yarn guide 16 extending coaxial with the axis of rotation of the spinning centrifuge 14, whereby the yarn guide 16 can be lowered in the direction R into its respective spinning centrifuge 14.

At each spinning station, a roving 24 is fed initially through a drafting device 26, only representative shown in FIG. 1, wherein the roving 24 is drawn, and therefrom the drawn roving 24 is fed through the yarn guide 16 from which the drawn roving 24 exits the lower end of the yarn guide 16 and extends in the form of a moving leg 20 which deposits onto an inner wall 22 of the rotating centrifuge 14 during which the roving 24 becomes twisted into a finished spun yarn 18 by the rotation of the centrifuge 14.

A drive mechanism, not represented, is respectively assigned to the yarn guides 16 and provides the yarn guides 16 with a continuous axial traversing motion CH and also lowers the yarn guides 16 continuously in the direction R during the spinning process.

A yarn sensor 28 is also assigned to each spinning station 12, preferably in the area of the yarn guide inlet, to detect the presence of the roving 24 drawn to create the yarn 18. In this case, it is contemplated that the yarn sensor 28 can be combined in a manner not shown or described in detail with and injector (not represented), which assures that the roving yarn 24 is threaded into the yarn guide 16 and the spinning station 12 can start spinning. More specifically, such an injector aspirates the roving 24 leaving the drafting device 26 and blows it into the yarn guide 16.

Since these pot spinning machines are generally well known within the textile industry, it is not believed to be necessary to illustrate or describe further details of the pot spinning machine for purposes of describing and understanding the present invention.

The pot spinning machine 10 represented in FIG. 1 functions as follows. Following an essentially simultaneous spinning start of all work stations 12, 12', 12", the roving 24 leaving the mouth of the respective yarn guide 16 at each spinning station 12, 12', 12" is placed against the inner wall 22 of the rotating spinning centrifuge 14, so that a yarn leg 20 is created which rotates with the spinning centrifuge 14. The yarn 18 being created in the process is deposited on the inner wall 22 of the spinning centrifuge 14 in the form of a yarn body, i.e., a spinning cake 8, as indicated by way of example by the dashed lines in the work station 12" of FIG. 1.

At the end of a predetermined spinning time or when reaching a predetermined amount of yarn, rewinding tubes (not represented) are delivered to the centrifuges 14, on which the yarn bodies 8 are rewound. In the course of this rewinding operation, a yarn body remnant 30, indicated by way of example at the spinning station 12', can occur, for example, by a yarn break occurring during the rewinding process. This yarn body remnant 30 remains in the respective spinning centrifuge 14 even after the rewinding tube has been removed. If this yarn body remnant 30 is not removed, then upon the start of subsequent spinning operation in the centrifuges 14, the new yarn leg 20 forming in the concerned work station 12' will encounter the yarn body remnant 30 left in the spinning centrifuge.

Figure 2:
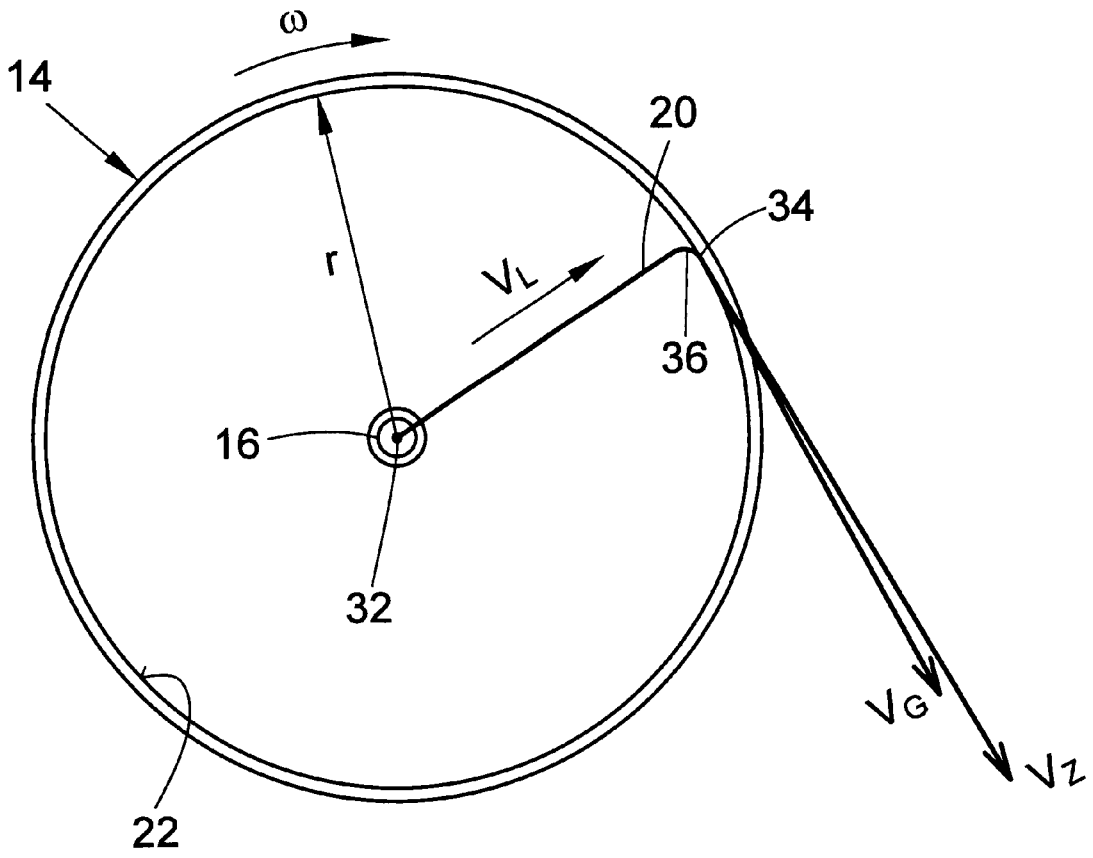
FIG. 2 is a schematic top plan view of a spinning centrifuge of the pot spinning machine of FIG. 1, in accordance with the method and device of the present invention.

To facilitate an understanding of the present invention, the relevant parameters affecting the course of spinning in the centrifuges will be explained by means of FIG. 2. To this end, a spinning centrifuge 14 has been schematically represented in FIG. 2 in a top plan view.

As already indicated above, the axis of rotation 32 of the spinning centrifuge 14 coincides with the longitudinal axis of the tubular yarn guide 16. It can be furthermore seen that the roving 24, or respectively the yarn 18, exiting from the yarn guide 16 is deposited on the rotating inner wall 22 of the spinning centrifuge 14, forming the yarn leg 20, and is taken along in the direction. In the process, the yarn 18 is deposited on the inner wall 22 at a constant delivery speed (winding speed) $V_L$. At the same time, the centrifuge 14 rotates at a constant angular velocity $V_Z$. At the impact point 34 of the yarn leg 20 on the inner wall 22 of the spinning centrifuge 14, a free radius r therefore results between the mouth of the yarn guide 16 and the inner wall 22.

The circumferential speed of the impact point 34 correspondingly results from the angular velocity $V_Z$ and the free radius r of the spinning centrifuge 14. It is true in principle that the circumferential speed results from the angular velocity and the radius r as $V=\omega*r$.

Because the angular velocity ω can be replaced by $2_\pi f$, wherein f represents the frequency, the result for the circumferential speed is $V_Z=2\pi*r$.

In what follows, $f_G$ indicates the rotary frequency of the yarn leg 20 and $f_Z$ the rotary frequency of the inner centrifuge wall 22.

The following equation then results in respect to the circumferential speed $V_G$ of the yarn leg end 36 in the area of the impact point 34:

$$V_G=V_Z-V_L.$$

From this the following can be derived:

$$2\pi f_G r=2_\pi f_Z*r-V_L.$$

$$f_G=2_\pi f*r-V_L$$

$$f_G=f_Z-V_L/2_\pi r.$$

It follows from this derivation, that the rotary frequency $f_G$ of the yarn leg 20 is a function of the free radius r, i.e., the smaller the free radius r, the lower the rotary frequency $f_G$ of the yarn leg 20.

This knowledge means that, by measuring the rotary frequency $f_G$ of the yarn leg 20, it is possible to draw conclusions as to the actual free radius r, and therefore as to a possible yarn body remnant 30 present in the spinning centrifuge 14. If, as indicated in FIG. 1 by means of the example of the work station 12', a yarn body remnant 30 is present, a reduction of the free radius r occurs as a result, so that in accordance with the above explained relationships, a lower rotational frequency $f_G$ of the yarn leg 20 exists at the work station 12'.

In respect to FIG. 1 and based on the above considerations in principle, the following results. As a rule, the yarn legs 20 each rotate around the yarn guide 16 at a rotary frequency $f_G$, which corresponds to the free radius r of the spinning centrifuge 14.

The movement of the respective roving 24 or yarn 14 is detected by means of the yarn sensors 28. This movement leads to an output signal of the yarn sensor, which indicates in the form of a noise signal that the respective yarn 18 is moving and therefore exists. Because of twisting in accordance with the rotary frequency $f_G$ of the yarn leg 20, a further yarn movement is superimposed on the delivery speed $V_L$ of the yarn 18. This additional yarn movement is directly proportional to the rotary frequency $f_G$ of the yarn leg 20.

Accordingly, the output signal of the yarn sensors 28 contains, besides the movement information corresponding to the delivery speed $V_L$ of the yarn 18, a signal portion which corresponds to the rotary frequency $f_G$ of the yarn leg 20.

Figure 1A:
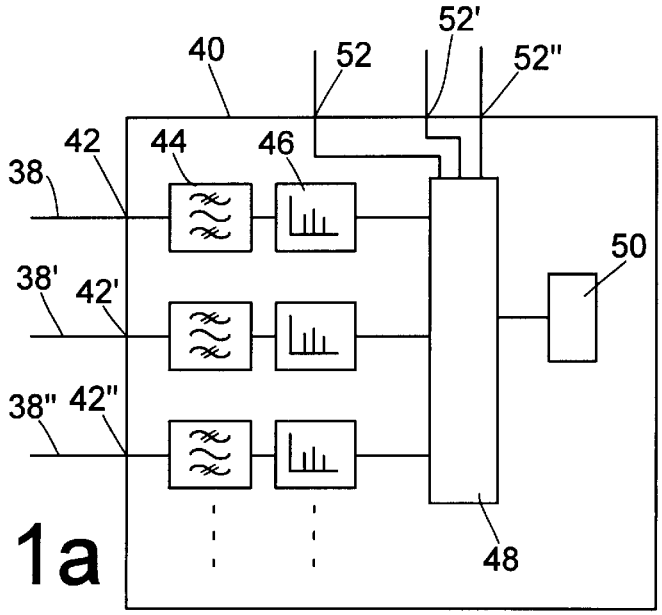
FIG. 1*a* is a further schematic representation of the pot spinning machine of FIG. 1.

As indicated in FIG. 1, the yarn sensors 28 are connected with a control device 40 via signal lines 38. As made clear by the schematically enlarged representation in FIG. 1*a*, the control device 40 has a number of inputs 42, 42', 42" corresponding to the number of work stations 12 of the pot spinning machine 10, so that every output signal of the yarn sensor 28 of each winding station 12 can be individually processed.

The inputs 42, 42', 42" are each connected with a filter module 44, each of which is followed by a frequency evaluation module 46. The frequency evaluation modules 46 are connected to a comparator 48, which is moreover connected to a memory element 50.

The comparator 48 is connected with the outputs 52 of the control device 40, wherein a number of outputs 52, 52', 52" corresponding to the number of work stations 12 of the pot spinning machine 10 is again provided. Each one of the outputs 52, 52', 52" is connected with a so-called slubbing stop device 54, not represented, which is assigned to the work stations 12 and which, with proper activation, causes the delivery of material by the respective drafting device 26 to be stopped.

An evaluation in accordance with the present invention of the output signals of the yarn sensors 28 by the control device 40, which customarily takes on the control functions for monitoring the operation of the pot spinning machine 10, can take place as follows, but it is to be explicitly understood that the control device 40 can of course also evaluate the output signals of the yarn sensors in other ways.

First, the output signals of the yarn sensors 28 are conducted through the filter modules 44 which are designed as bandpass filters, for example. In this manner, signal portions in a defined frequency band, which are located in the range of the balloon frequency at the yarn sensor 28, are filtered out of the noise signal present thereat. Thereafter, this filtered-out frequency range is conducted through the frequency evaluation modules 46. It is possible here to perform a spectral analysis, for example by means of a fast Fourier transformation or other known frequency evaluation methods, in such a way that the spectral portions, which correspond to the additional yarn movement, and therefore to the rotary frequency $f_G$ of the yarn leg 20, are filtered out. These are subsequently compared in the comparator 48 with stored set values, which are made available by the memory element 50, for example. The rotary frequency $f_G$ of the yarn legs 20 can be pre-calculated, based on the known geometry of the spinning centrifuges 14, and therefore the known free radius r of an empty spinning centrifuge 14.

If it is found in the course of this operation that the rotary frequency $f_G$ of the yarn leg 20 is lower than the preset value, the conclusion may be drawn that this must result from a reduced free radius r, and therefore must indicate the presence of a yarn body remnant 30 in the corresponding spinning centrifuge 14. A signal assigned to the respective work station 12 is provided via the comparator 48 to the respective output 52, so that the delivery of roving material to the respective work station 12' is directly interrupted by means of the slubbing stop device 54, which is known and therefore not represented or explained in greater detail.

In accordance with a further variation, a comparison of each respective rotary frequency for a given work station with each other of the rotary frequencies $f_G$ of the yarn legs 20 of the work stations 12 can be performed by means of the comparator 48.

It will therefore be clear from the above disclosure of the present invention that it is thereby possible directly following the start of a spinning process of the pot spinning machine 10 to detect whether, as indicated by means of the example of the work station 12' in FIG. 1, a yarn body remnant 30 is still present in one of the spinning centrifuges 14. It is then possible to remove the respective work station 12' immediately from production and clean it. The spinning process is preferably continued at the other work stations 12, 12", etc., and the affected work station 12' may be later actuated after being cleaned. By means of the method of the present invention, it is achieved that all work stations 12 are fully available again at the time of the next mutual spinning process, except if in the meantime another yarn body remnant 30 occurs, for example because of another yarn break, in another spinning centrifuge 14.

It will be understood that the detection of the rotary frequency of each yarn leg need not necessarily take place by means of the yarn sensor 28 explained in the present exemplary embodiment. It is easily conceivable within the scope and substance of the present invention to use a sensor arrangement for determining the rotary frequency of the yarn leg, such as has been described, for example, in German Patent Publication DE 195 23 835 A1 in connection with the initiation of an emergency rewinding process.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a method of spinning yarn in a pot spinning machine having a plurality of work stations each including a rotating spinning centifuge and a guide reciprocable with respect thereto, wherein the method comprises at each work station the steps of drawing a fiber slubbing by means of a drafting device, feeding the drawn slubbing into the spinning centrifuge via the reciprocable guide, delivering the drawn slubbing in the form of a rotating leg extending from the guide to an inner wall of the spinning centrifuge while twisting the slubbing into the form of a yarn, and depositing the yarn in the form of a yarn cake on the inner wall of the spinning centrifuge, the improvement comprising automatically checking the spinning centrifuge of each individual work station for yarn cake remnants at a start of the spinning method.

2. The method in accordance with claim 1, further comprising detecting a rotary frequency of the yarn leg of each individual spinning centrifuge and comparing the detected rotary frequency with a set value.

3. The method in accordance with claim 2, further comprising sensing movement of the yarn.

4. The method in accordance with claim 2, further comprising measuring a rotary frequency of a yarn balloon which is proportional to the rotary frequency of the yarn leg.

5. The method in accordance with claim 4, further comprising filtering the rotary frequency of the yarn balloon from a noise signal representing the movement of the yarn.

6. The method in accordance with claim 5, further comprising performing a frequency analysis of frequency signals corresponding to the filtered rotary frequency of the yarn balloon.

7. The method in accordance with claim 1, further comprising determining the set value on the basis of known geometric dimensions of the spinning centrifuge when empty.

8. The method in accordance with claim 1, further comprising checking the rotary frequencies of the rotating yarn legs in all work stations simultaneously and comparing the rotary frequencies with each other.

9. The method in accordance with claim 1, further comprising stopping the feeding of the slubbing at an individual spinning centrifuge upon detection of a yarn cake remnant.

10. In a pot spinning machine having a plurality of work stations each including a rotating spinning centrifuge and a guide reciprocable with respect thereto, for introducing a drawn fiber slubbing into the centrifuge, the improvement comprising a sensor device for detecting at least one physical value prevailing at the spinning centrifuge of each individual work station in the course of a spinning operation and determining the presence of a yarn cake in the respective spinning centrifuge, wherein the sensor device is a yarn sensor arranged between a drafting device and the reciprocable guide for detecting the presence of the slubbing, a filter stage for detecting a signal corresponding to a rotary frequency of a yarn leg extending from the reciprocable guide to the spinning centrifuge, and an evaluation circuit in which the signals corresponding to the rotary frequency of the yarn leg may be compared with a preset value.

11. The pot spinning machine in accordance with claim 10, wherein the sensor device comprises a respective sensor associated each work station and further comprising a control device to which each sensor of the work stations is connected.

12. The pot spinning machine in accordance with claim 11, wherein the control device comprises a plurality of filter modules and frequency evaluation modules corresponding to the number of work stations.

13. The pot spinning machine in accordance with claim 12, wherein the filter modules and the frequency evaluation modules are connected to a comparator which is connected with a plurality of outputs of the control device corresponding to the number of work stations.

14. The pot spinning machine in accordance with claim 13, wherein each of the outputs is connected with a stop device for the slubbing, which stop device is associated with a respective one of the work stations.

* * * * *